US007763152B2

(12) United States Patent
Suzuki et al.

(10) Patent No.: US 7,763,152 B2
(45) Date of Patent: Jul. 27, 2010

(54) ION EXCHANGE MEMBRANE ELECTROLYZER

(75) Inventors: Minoru Suzuki, Tamano (JP); Masakazu Kameda, Tamano (JP)

(73) Assignees: Chlorine Engineers Corp., Ltd., Tokyo (JP); Tosoh Corporation, Shunan-shi (JP)

( * ) Notice: Subject to any disclaimer, the term of this patent is extended or adjusted under 35 U.S.C. 154(b) by 560 days.

(21) Appl. No.: 11/896,681

(22) Filed: Sep. 5, 2007

(65) Prior Publication Data

US 2008/0053821 A1 Mar. 6, 2008

(30) Foreign Application Priority Data

Sep. 6, 2006 (JP) ..... 2006-241646

(51) Int. Cl.
*C25B 9/02* (2006.01)
*C25B 9/12* (2006.01)

(52) U.S. Cl. ..... 204/252; 204/255; 204/257; 204/263; 204/283; 204/286.1; 204/288.3; 204/288.6

(58) Field of Classification Search ..... 204/252, 204/257, 263, 283, 286.1, 288.3, 288.6
See application file for complete search history.

(56) References Cited

U.S. PATENT DOCUMENTS 4,096,054 A 6/1978 Specht et al.
5,221,452 A * 6/1993 Nakao et al. ..... 204/258
5,873,987 A * 2/1999 Katayama et al. ..... 204/284
6,312,572 B1 * 11/2001 Katayama ..... 204/254
2003/0155232 A1 * 8/2003 Katayama et al. ..... 204/252
2003/0188966 A1 * 10/2003 Katayama ..... 204/297.14
2005/0029116 A1 * 2/2005 Bulan et al. ..... 205/334
2007/0068799 A1 * 3/2007 Shinomiya et al. ..... 204/280
2007/0235338 A1 * 10/2007 Kodama et al. ..... 204/627
2007/0278095 A1 * 12/2007 Asaumi ..... 204/297.14

FOREIGN PATENT DOCUMENTS

EP 1338681 A2 8/2003
EP 1378589 A1 1/2004

OTHER PUBLICATIONS

European Search report dated Sep. 18, 2008 issued in corresponding European Application No. 07115587.3.

* cited by examiner

*Primary Examiner*—Bruce F Bell
(74) *Attorney, Agent, or Firm*—Westerman, Hattori, Daniels & Adrian, LLP

(57) ABSTRACT

There is provided an ion exchange membrane electrolyzer, wherein at least one electrode is energized by coming into contact with plate spring bodies formed on the electrode side of an electrode holding member forming a space with an electrode chamber partition bonded to a plate-like electrode chamber partition by a strip-like bonded portion, the electrode has a connected portion extending from a plane parallel to the ion exchange membrane toward the electrode holding member side in a direction perpendicular to the electrode plane, the connected portion is provided with an engaging opening extending in a direction perpendicular to the electrode plane, and the engaging opening engages with an engaging member, permitting the electrode to move in a direction perpendicular to the electrode plane within the displacement range of the plate spring bodies.

4 Claims, 4 Drawing Sheets

ION EXCHANGE MEMBRANE ELECTROLYZER

CROSS-REFERENCE TO RELATED APPLICATIONS

This application is based upon and claims the benefit of priority from prior Japanese Patent Application No. 2006-241646, filed Sep. 6, 2006, the entire contents of which are incorporated herein by reference.

BACKGROUND

1. Technical Field

The present invention relates to an ion exchange membrane electrolyzer, and particularly to an ion exchange membrane electrolyzer capable of maintaining the gap between electrodes at a predetermined extent.

2. Related Art

In an electrolyzer used for electrolyzing aqueous solutions, the voltage required for electrolysis depends on various factors. In particular, the gap between anode and cathode has a large effect on the voltage of the electrolyzer. So, there are taken measures of reducing the gap between the electrodes to lower the voltage of the electrolyzer, thereby reducing consumption of the energy required for electrolysis.

In an ion exchange membrane electrolyzer used for electrolyzing a brine, the voltage of the electrolyzer is lowered by arranging three elements of anode, ion exchange membrane and cathode in close contact with one another. However, in a large electrolyzer provided with electrodes having an area of several square meters respectively, in case where the anode and cathode are connected to an electrode chamber by a rigid member, it has been difficult to reduce the gap between the electrodes to maintain the gap at a predetermined value by bringing both electrodes into close contact with an ion exchange membrane.

So, there is proposed an electrolyzer capable of adjusting the gap between the electrodes by using a flexible member for at least either of the anode or cathode. For example, there are proposed electrodes in each of which a flexible member comprising metallic fine wire woven fabric, unwoven fabric, net or the like is arranged on a porous electrode substrate.

Since the flexible members of these electrodes comprises metallic fine wires, there have been problems that the gap between the electrodes becomes uneven due to a partially deformed portion of an electrode and that the fine wires stick into an ion exchange membrane if the electrode is pushed excessively by the back pressure of a counter electrode chamber.

Moreover, there are proposed electrolyzers in which conductive connections are formed between the partition side of an electrode chamber and the electrodes by means of many plate-like spring materials. These electrolyzers are disclosed in, for example, JP-A-57-108278 and JP-A-58-37183.

Flexible electrodes using plate spring bodies exhibit better behaviors against partial deformations when being pushed than electrodes using members comprising fine wires, however, in these electrolyzers the plate spring bodies extend from a flexible cathode holding member obliquely only in the same direction.

Accordingly, if any force is exerted from an electrode plane side, on the electrode planes there is exerted force moving in one direction in which the spring materials are deformed due to the displacement of the plate spring bodies. As a result, the electrodes coming into contact with the plate spring bodies can be displaced, or an ion exchange membrane can be damaged in the displacement of the electrodes if the ion exchange membrane is in contact with the electrodes.

Then, in order to solve such problems, the present inventor proposes an ion exchange membrane electrolyzer capable of maintaining the gap to the counter electrode at a predetermined extent without the lateral displacement of the electrodes even if the electrode planes are pushed onto the plate spring bodies by arranging plates provided with plate spring bodies on a plate-like electrode chamber partition, a collector and the like and by mutually inserting comb-like opposed plate spring bodies into one another. Such an electrolyzer is disclosed in, for example, Japanese Patent No. 3501453.

It is an object of the present invention to provide an ion exchange membrane electrolyzer that can be easily assembled, has a high assembly precision and causes no lateral displacement of the electrodes coming into contact with the plate spring bodies, in which plates provided with plate spring bodies are arranged on a plate-like electrode chamber partition, collector and the like and comb-like mutually opposed plate spring bodies are inserted into one another.

SUMMARY

The present invention provides an ion exchange membrane electrolyzer in which at least one electrode is energized by coming into contact with plate spring bodies formed on the electrode side of an electrode holding member forming a space with an electrode chamber partition bonded to a plate-like electrode chamber partition by a strip-like bonded portion, the electrode has a connected portion extending from a plane parallel to the ion exchange membrane toward the electrode holding member side in a direction perpendicular to the electrode plane, the connected portion is provided with an engaging opening extending in a direction perpendicular to the electrode plane, and the engaging opening engages with an engaging member, permitting the electrode to move in a direction perpendicular to the electrode plane within the displacement range of the plate spring bodies.

Moreover, a connected portion bent in a direction perpendicular to the electrode plane is provided, and in the connected portion, an engaging opening enlarged in a direction perpendicular to the electrode plane is provided and is engaged with the engaging member. Thus, the electrode is enabled to move corresponding to the displacement of the plate spring bodies in a direction perpendicular to the electrode plane, and further the electrode can be prevented from being displaced in a direction parallel to the electrode plane.

Moreover, in the ion exchange membrane electrolyzer, the engaging opening is an opening formed in the connected portion of the electrode extending from a plane parallel to the ion exchange membrane in a perpendicular direction or an opening formed in an engaging member mounted on the connected portion.

In the ion exchange membrane electrolyzer, the plate spring bodies comprise a plurality of comb-like spring bodies having the same length and extending obliquely from plate-like bodies of the electrode holding member.

In the ion exchange membrane electrolyzer, the plate-like bodies to which the plate spring bodies are connected are formed in a portion joined to the electrode chamber partition by the strip-like bonded portion, being parallel to the electrode chamber partition and forming a space with the electrode chamber partition. The space formed with the electrode chamber partition is a descending flow channel of an electrolyte and an ascending flow channel of an electrolyte is formed on the electrode side.

Moreover, the ion exchange membrane electrolyzer enables to maintain the gap between the electrodes at a predetermined extent and to ensure the circulation of an electrolyte in the electrolyzer, realizing an effective electrolysis.

According to the ion exchange membrane electrolyzer of the present invention, at least one electrode is held by the plate spring bodies inserted into one another, a connected portion in a direction perpendicular to the electrode plane is formed in the electrode, an engaging opening extending in a direction vertical to the electrode plane is formed in the connected portion, and the electrode is held by the engaging member of the engaging opening. Thus, an ion exchange membrane electrolyzer capable of maintaining the gap between the electrodes at a predetermined extent without causing lateral displacement or the like can be provided.

BRIEF DESCRIPTION OF THE DRAWINGS

The invention will be described with reference to the accompanying drawings, wherein like numbers reference like elements.

DESCRIPTION OF THE EXEMPLARY EMBODIMENT

The present invention enables, in an electrolyzer in which plates provided with plate spring bodies are arranged on a plate-like electrode chamber partition, a collector, and so on, displacement of electrodes is prevented in the ion exchange membrane electrolyzer in which comb-like plate spring bodies are opposed to mutually inserted into each other to bring the electrodes into contact with each other, by providing connected portions vertical to the electrode planes, and providing engaging openings that limit the movement of the electrodes to a direction vertical to the electrode planes and engaging members having a width corresponding to that in a direction parallel to the electrode planes of the engaging openings. Thus, the gap to an ion exchange membrane can be set at a desired extent without causing the displacement or the like of the electrodes.

Now, the present invention will be described with reference to the accompanying drawings.

Figure 1A:
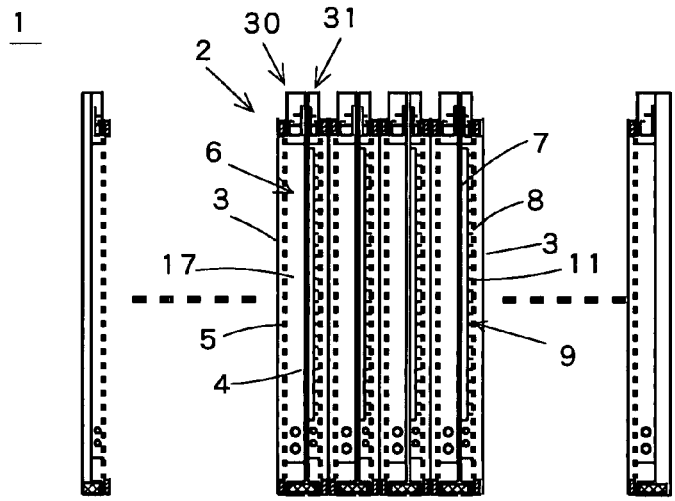
FIGS. 1A to 1C are views illustrating one embodiment of an electrolyzer of the present invention.
Figure 1B:
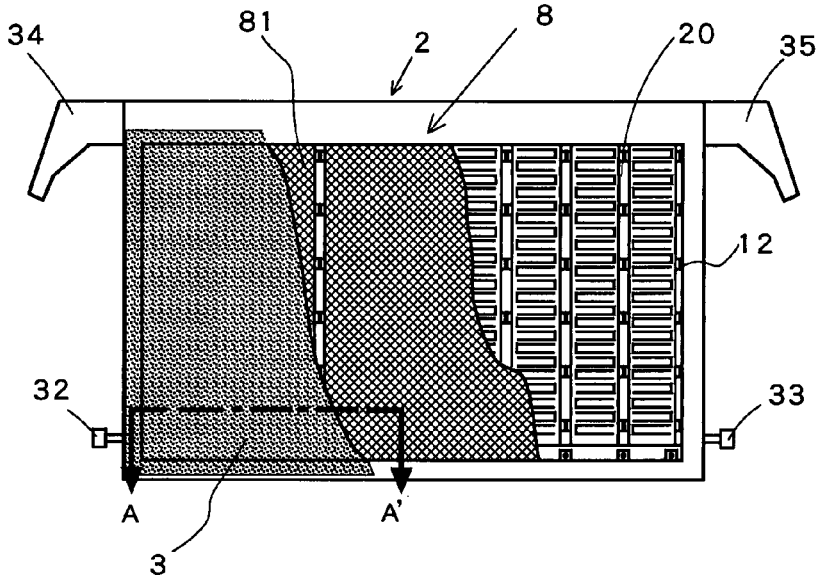
Figure 1C:
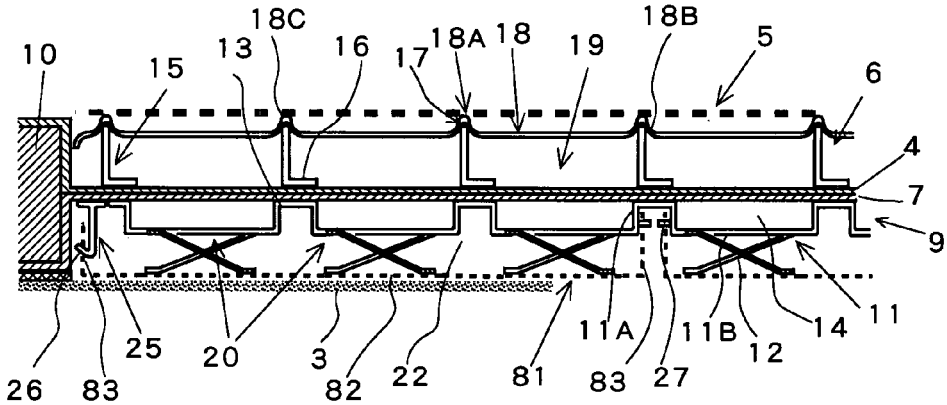

FIG. 1A is a view illustrating one embodiment of an electrolyzer of the present invention and is further a view illustrating a cross section of an ion exchange membrane electrolyzer, in which a plurality of electrolyzer units are stacked. FIG. 1B is a plan view of an electrolyzer unit seen from the cathode side. FIG. 1C is a sectional view taken along the line A-A' of FIG. 1B.

As shown in FIG. 1A, the ion exchange membrane electrolyzer 1 is assembled by stacking a plurality of bipolar electrolyzer units 2 via ion exchange membranes 3.

In the respective electrolyzer units 2, there is provided an anode 5 spaced from an anode chamber partition 4, forming an anode chamber 6. Moreover, there is provided a cathode 8 spaced from a cathode chamber partition 7, a cathode chamber 9 is formed between an ion exchange membrane 3 and the cathode chamber partition 7, and a frame body 10 is provided around the respective electrolyzer units 2, preventing the deformations of the respective electrolyzer units 2.

Moreover, in the upper portions of the anode chamber 6 and cathode chamber 9, there are provided an anode chamber side electrolyte separating means 30 and cathode chamber side electrolyte separating means 31, respectively.

Moreover, an anolyte supply pipe 32 is provided in the anode chamber 6 of the respective electrolyzer units 2, and in the anode chamber side electrolyte separating means 30, there is provided an anode chamber discharge pipe 34 for discharging a diluted anolyte and gas.

Moreover, a catholyte supply pipe 33 is provided in the cathode chamber 9 of the respective electrolyzer units 2, and in the cathode chamber side electrolyte separating means 31, there is provided a cathode chamber discharge pipe 35 for discharging catholyte and gas.

Further, the anolyte supply pipe and cathode chamber discharge pipe are, as shown in the figure, arranged on the same side, however, the anolyte supply pipe and cathode chamber discharge pipe may be arranged opposed to each other, and the anolyte supply pipe and cathode supply pipe may be arranged on the same side.

As shown in FIGS. 1B and 1C, on the cathode chamber partition 7, there is mounted a plate spring body holding member 11, the plate spring body holding member 11 is energized by bringing the cathode 8 into contact with the tips of a plurality of pairs of comb-like plate spring bodies 12 extending obliquely from the plate spring body holding member 11, and the respective pairs of the comb-like plate spring bodies 12 are arranged with the mutually opposed adjacent plate spring bodies 12 being inserted into one another. Moreover, the ion exchange membrane 3 is arranged on the plane of the cathode 8.

Since the cathode 8 is in contact with the plate spring bodies 12 extending in mutually opposite directions from the plate spring body holding member 11, only the forces of the cathode chamber partition and in a vertical direction is exerted on the cathode 8. As a result thereof, the cathode is displaced in a direction perpendicular to the cathode chamber partition 7 due to the repulsion of the plate spring bodies 12 and the cathode 8 is prevented from moving parallel to the cathode chamber partition 7, enabling the cathode to be located at a predetermined position without causing problems of damaging the ion exchange membrane plane.

Moreover, in the strip-shaped bolded portion 13, the cathode chamber partition 7 and plate spring body holding member 11 are bonded closely to each other. The plate spring body holding member 11 is composed of a longitudinal portion 11A connected to the bonded portion 13 and a lateral portion 11B being parallel to the cathode chamber partition 7 and orthogonal to the longitudinal portion. The plate spring body holding member 11 is provided by inserting the comb-like mutually opposed plate spring bodies 12 into one another in the lateral portion 11B thereof, and there is formed a catholyte circulation passage 14 between the plate spring body holding member 11 and cathode chamber partition 7.

As a result, the electrolyte prepared by gas-liquid separating a gas-liquid mixed fluid that has ascended a space on the cathode 8 plane side in the upper portion of the cathode chamber partially flows out of the electrolyzer via the cathode chamber discharge pipe 35 and partially descends the catholyte circulation passage 14, flows out into a space on the cathode plane side in the lower portion of the cathode chamber, is mixed with catholyte supplied from the catholyte supply tube 33 and feeded into the cathode chamber, and is subjected to electrolysis in the cathode.

As described above, the circulation of the electrolyte in the cathode chamber is promoted, resulting in a uniform concentration distribution of the electrolyte and an effective electrolysis.

On the other hand, the bottom portion 16 of a L-shaped anode holding member 15 is bonded to the anode chamber partition 4, further, the bottom portion and a rectangular tip 17 are bonded to the bonded portion 18A of a plate-like downcomer 18. Since the anode holding member 15 exerts a function of holding and energizing the anode 5, the bottom portion 16 of the anode holding member 15 is preferably provided on the back face of the bonded portion 13 of the cathode chamber partition 7 so as to reduce the conducting resistance.

In the bonded portion 18A, a recess 18B is formed on the plane of the anode chamber partition 4 side and the anode 5 is bonded to a protrusion 18C protruding toward the anode 5 side so as to mount the anode holding member 15 steadily on a bonded portion 18A.

Gas-liquid mixed fluid that has ascended a space on the side of the anode 5 plane of the downcomer 18 is gas-liquid separated in the upper portion of the anode chamber, anolyte partially descends an anolyte circulation passage 19, and the electrolyte partially flows out of the anode chamber discharge pipe 34. The anolyte that has descended the anolyte circulation passage 19 flows out into a space on the anode plane side in the lower portion of the electrode chamber on the anode side, is mixed with anolyte supplied from the anolyte supply tube 32 provided in the electrolyzer, and is subjected to electrolysis on the anode plane.

In the ion exchange membrane electrolyzer of the present invention, the cathode 8 has a cathode plane 82 opposing to the ion exchange membrane 3 and a connected portion 83 vertical to the cathode plane 82, and engaging openings 85 are provided in the connected portion 83. Moreover, the engaging openings 85 are engaged with hook-like engaging members 25 or plate-like engaging members 26 provided in the longitudinal portion connected to the bonded portion 13 of the plate spring body holding member 11.

The engaging openings 85 have openings through which the cathode is movable in a direction vertical to the cathode plane 82, enabling the gap between the electrodes to be adjusted by the plate spring bodies 12.

Moreover, in an example shown in FIG. 1C, there is shown a case in which one unit cathode 81 is arranged between the cathode chamber partition 7 of the plate spring body holding body 11 corresponding to four rows of strip-like connected portions 13, that is, three rows of plate spring body holding portions 20.

The number of the plate spring body holding portions 20 corresponding to the unit cathode 81 is not limited to three, any number thereof can be used depending on the size of an electrolyzer, and, for example, about 5 to 6 plate spring body holding portions can be used.

As plate spring bodies and plate spring body holding members, in the environment within the cathode chamber, there can be used nickel, nickel alloy, stainless steel and the like having a good corrosion resistance. As a cathode, there can be used one obtained by forming a coating of an electrode catalytic material such as a platinum metal-containing layer, a Raney nickel-containing layer, an activated carbon-containing nickel layer or the like on the surface of a substrate of nickel, nickel alloy porous body, net like body, expanded metal or mixtures thereof, reducing hydrogen excess voltage.

Moreover, the size of the plate spring bodies can be determined depending on the areas of the electrodes in the electrolyzer. For example, sizes of 0.2 mm to 0.5 mm in thickness, 2 mm to 10 mm in width and 20 mm to 50 mm in length can be included.

In addition, in the above-described description, there is described an electrolyzer capable of adjusting the gap between the cathode and opposing anode by adjusting the gap between the cathode coming into contact with the comb-like plate spring bodies provided on the cathode chamber side and the cathode chamber partition, however, the gap between the electrodes may be adjusted by fixing the gap between the cathode and cathode chamber partition and providing comb-like plate spring bodies provided on the anode chamber side, thereby enabling the gap between the anode and anode chamber partition to be adjusted.

Moreover, when plate spring bodies and a plate spring body holding member are provided on the anode side, thin film forming metals such as titanium, tantalum, zirconium and the like or alloys of such metals can be used. As an anode, there can be used one obtained by forming a coating of an electrode catalytic material containing a platinum metal or an oxide thereof on the surface of thin film forming metals such as titanium, tantalum, zirconium and the like or alloys of such metals.

Therefore, in the above descriptions of FIGS. 1A to 1C, the cathode and anode can be replaced with anode and cathode, respectively. Moreover, the cathode and anode may be collectively referred to as electrodes.

Figure 2A:
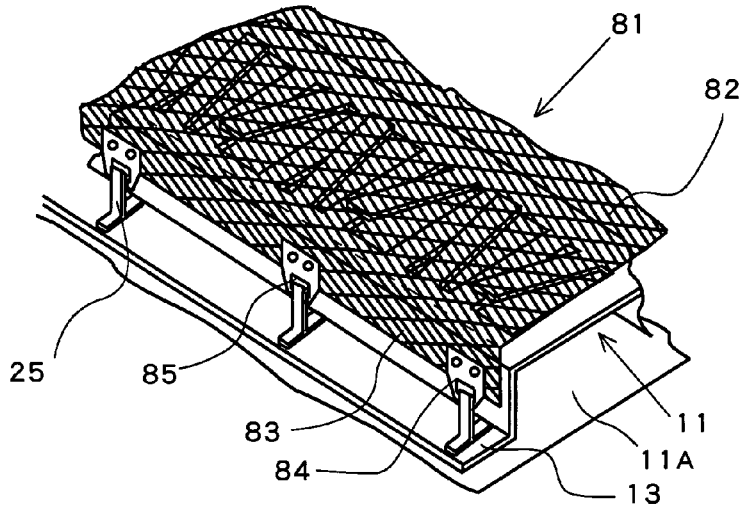
FIGS. 2A to 2C are views illustrating how a plate spring body holding member is mounted on a cathode.

FIG. 2A is a view illustrating how a plate spring body holding member is mounted on a cathode and is also a perspective view illustrating a portion from the strip-like bonded portion 13 to one plate spring body holding portion 20.

The plate spring body holding member 11 is bonded to the cathode chamber partition 7 in the strip-like bonded portion 13 in close contact with each other.

Moreover, the unit cathode 81 has a cathode plane 82 opposing to the counter electrode side and a connected portion 83 vertical to the cathode plane 82. In the connected portion 83, there are provided a plurality of engaging members 84 at some intervals, and an engaging opening 85 is provided in each of the engaging members 84.

A hook 26 of a hook-like engaging member 25 mounted on the strip-like bonded portion 13 of the plate spring body holding member 11 is engaged with the engaging opening 85. The hook portion 26 of the hook-like engaging member 25 has allowance enabling the unit cathode 81 to move in a direction vertical to the cathode plane with being engaged with the engaging opening 85.

Therefore, after the hook 26 of the hook-like engaging member 25 has been inserted into the engaging opening 85, the unit cathode 81 is held in a desired position by the repulsive force of the plate spring bodies 12 while the plate spring bodies 12 provided in the plate spring body holding member 11 is being pushed toward the cathode chamber partition side.

Figure 2B:
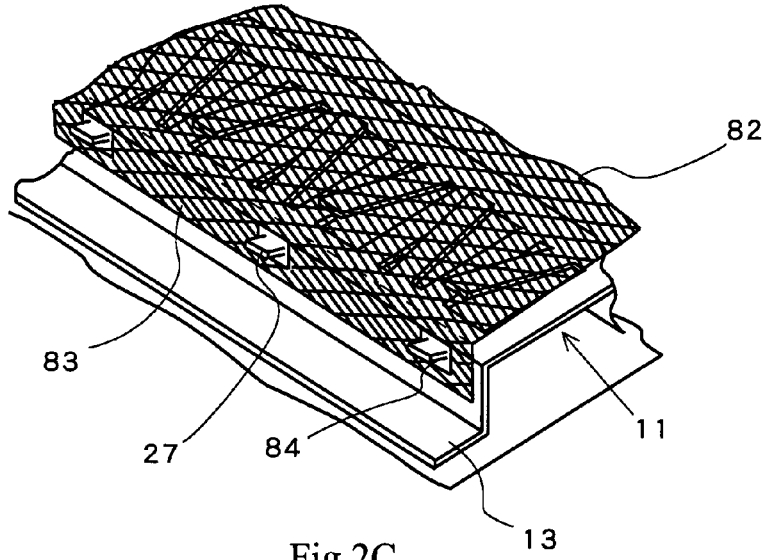

Moreover, FIG. 2B is a view illustrating a method of holding an electrode according to another embodiment.

The electrode shown in FIG. 2B has a cathode plane 82 facing the counter electrode side of the unit cathode 81 and a connected portion 83 vertical to the cathode plane 82. In the connected portion 83, there are provided a plurality of engaging openings 85 at some intervals.

Moreover, a plate-like engaging member 27 bonded to the longitudinal portion 11A of the plate spring body holding member 11 is engaged with the engaging opening 85. The plate-like engaging member 27 has allowance enabling the unit cathode 81 to move in a direction vertical to the cathode plane 82 with being engaged with the engaging opening 85.

Therefore, after the plate-like engaging member 27 has been inserted into the engaging opening 85, the unit cathode 81 is held in a desired position by the repulsive force of the plate spring bodies 12.

Both in the cases shown in FIGS. 2A and 2B, the connected portion 83 of the unit cathode 81 may be integrally fabricated with the cathode plane 82 by the same material. However, the connected portion 83 may be fabricated from a plate material having no openings and engaging openings may be provided in predetermined positions, or a plate material may be bonded only to the periphery of the engaging openings.

Figure 2C:
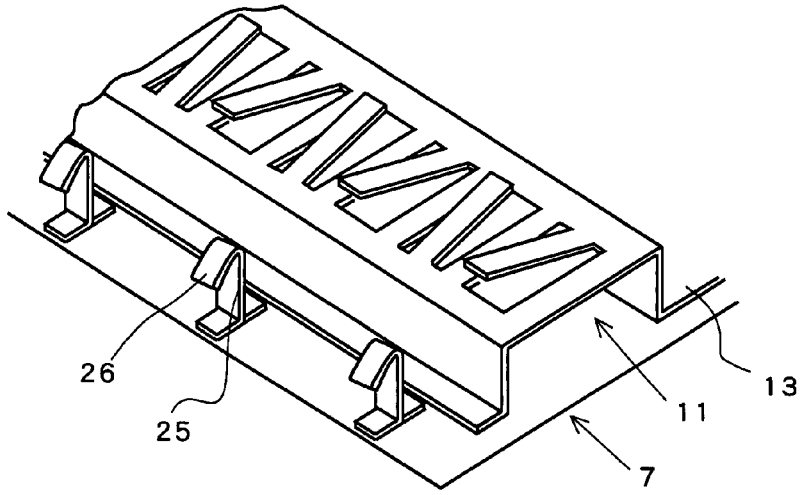

Moreover, FIG. 2C is a view illustrating one example of an engaged portion with the electrode of the plate spring body holding member 11 that is nearest to the frame body of the electrolyzer of the present invention, and is further a view illustrating a state in which the electrode is not mounted.

The plate spring body holding member 11 in the vicinity of the frame body of the electrolyzer is bonded to the cathode chamber partition 7 in the strip-like bonded portion 13, and a hook-like engaging member 25 is provided close to the strip-like bonded portion 13.

The effect of the hook portion 26 of the hook-like engaging member 25 enables the electrode to be prevented from being detached from the hook-like engaging member even if the electrode is pushed toward the plate spring body holding member side, and the gap to the plate spring body holding member is reduced.

Figure 3A:
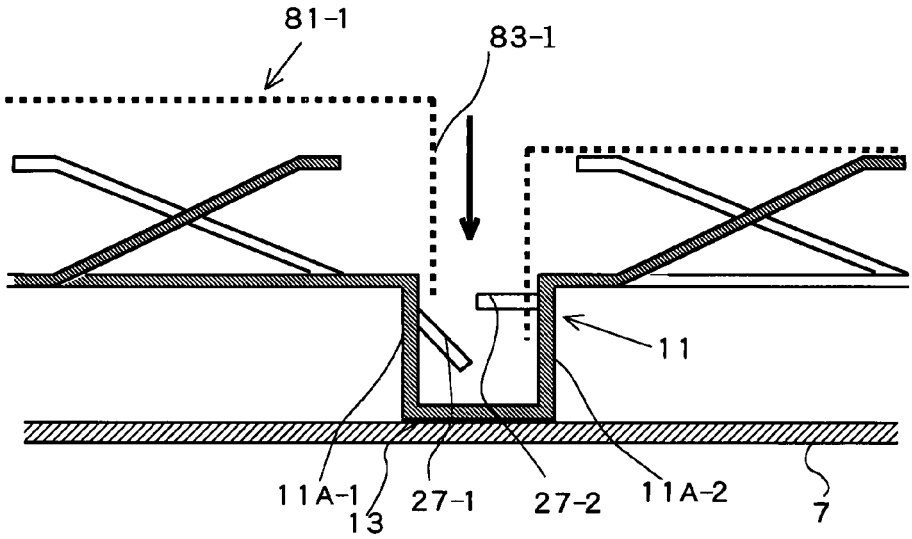
FIGS. 3A to 3C are views illustrating one example of a method of attaching plate spring bodies.
Figure 3B:
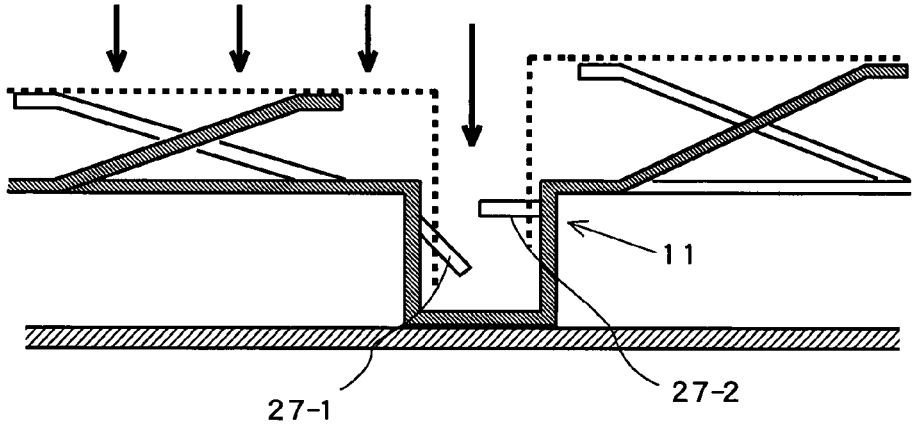
Figure 3C:
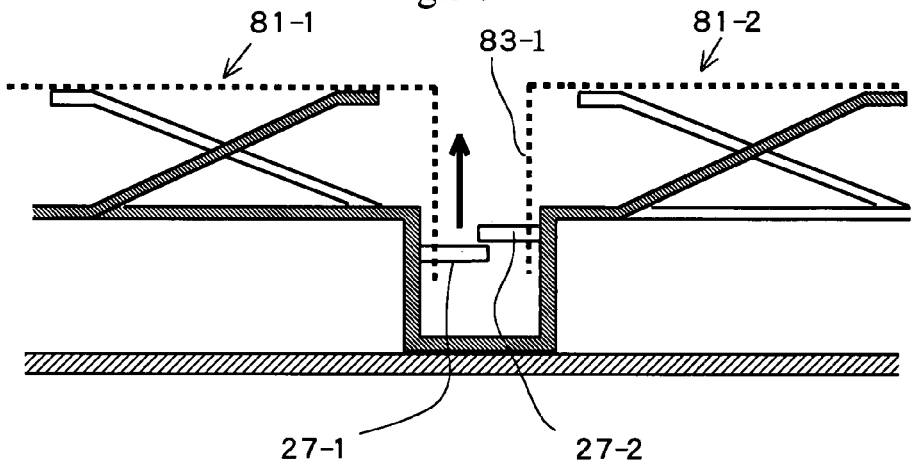

FIGS. 3A to 3C are views illustrating one example of a method of mounting plate spring bodies, and is also a sectional view showing the vicinity of the strip-like bonded portion between the cathode chamber partition and the plate spring body holding member.

As shown in FIG. 3A, the plate spring body holding member 11 is bonded to the cathode chamber partition 7 at the strip-like bonded portion 13, and a plate-like engaging member 27-1 inclined obliquely toward the cathode chamber partition 7 is mounted on a longitudinal portion 11A-1 of the plate spring body holding member 11. Moreover, a plate-like engaging member 27-2 is mounted also on a longitudinal portion 11A-2 opposing to the longitudinal portion 11A-1, and a unit cathode 81-2 is already attached to the plate-like engaging member 27-2.

When the unit cathode 81-1 is pushed toward the cathode chamber partition 7, the connected portion 83-1 provided perpendicular to the unit cathode 81-1 moves to the lower portion of the plate-like engaging member 27-1 and engages with the plate-like engaging member 27-1 formed in the connected portion 83-1 as shown in FIG. 3B because the plate-like engaging member 27-1 is arranged obliquely to the cathode chamber partition 7.

Subsequently, as shown in FIG. 3C, when the unit cathode 81 is drawn up using a jig such as an L-shaped hook or the like, the plate-like engaging member 26-1 becomes parallel to the cathode chamber partition 7.

As a result, the effect of the plate-like engaging member 27-2 engaged with an engaging opening provided in the connected portion 83-2 of the already attached unit cathode 81-2 enables the respective unit electrodes to maintain a predetermined electrode gap due to the effect of the plate spring body holding member without causing lateral displacement, falling and the like.

Moreover, when detaching any unit cathode, a unit cathode can be detached by pushing the plate-like engaging members 27-1 and 27-2 into the cathode chamber partition side using a jig such as an L-shaped hook or the like and bending them obliquely in contrast to the attachment of the unit cathode 81-1 or 81-2.

Figure 4A:
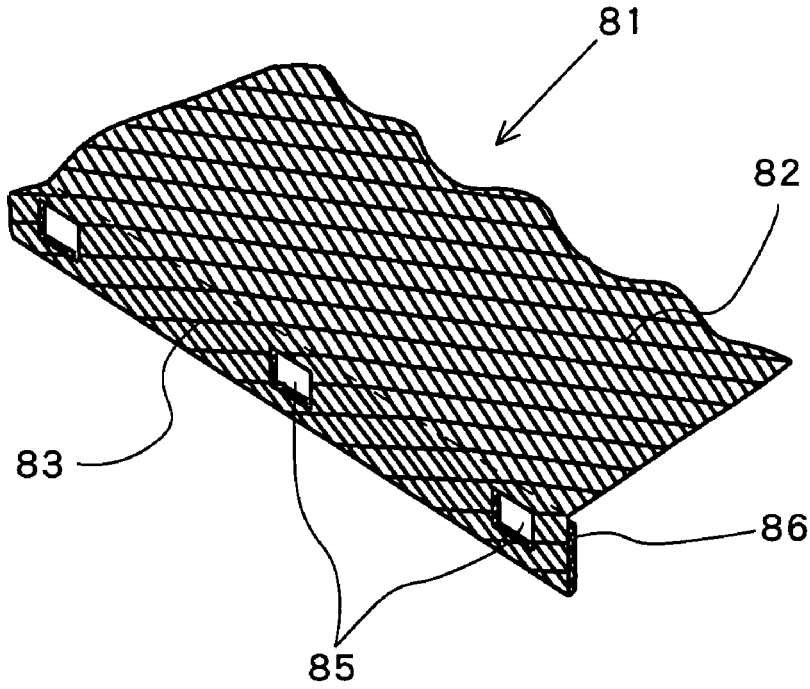
FIGS. 4A and 4B are views illustrating electrodes held by the plate spring body holding members of the ion exchange membrane electrolyzer of the present invention.
Figure 4B:
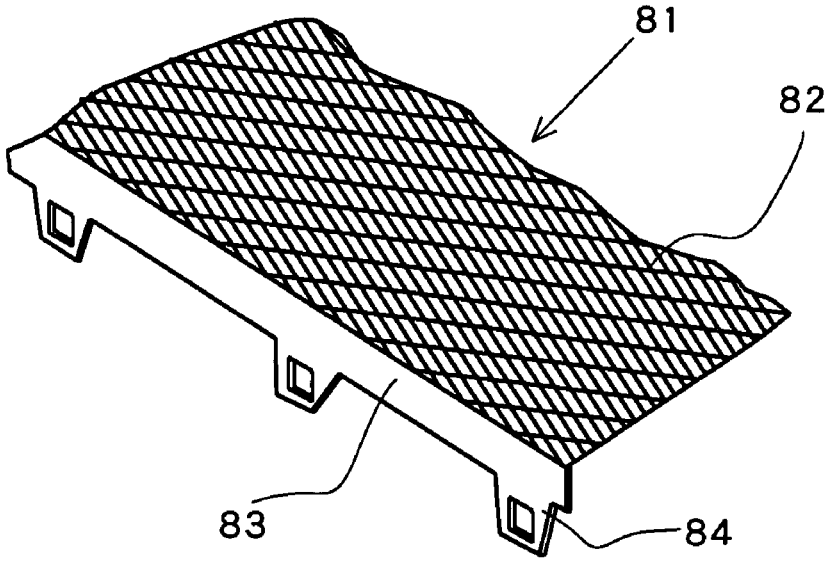

FIGS. 4A and 4B are views illustrating electrodes held by the plate spring body holding members of the ion exchange membrane electrolyzer, and are also views illustrating a cathode as an example.

Each of the unit cathodes shown in FIGS. 2A to 2B has a connected portion 83 formed by bending the member forming the cathode plane 82 of the unit cathode 81. In FIG. 2A, an engaging member is provided in the connected portion, and in FIG. 2B, an engaging opening is provided in the connected portion.

In contrast FIG. 4A shows a unit cathode 81 in which a connected portion 83 is formed by bending an end of the unit cathode 81 perpendicularly and a tip portion 86 is overlapped by being folded by 180° to obtain a two-fold connected portion 83. Thereby, not only the strength of the connected portion 83 and engaging opening 85 is increased, but also the rigidity of the cathode plane can be improved.

Moreover, FIG. 4B shows a unit cathode 81 in which a connected portion 83 perpendicular to the unit cathode 81 is formed from a plate material having no openings and an engaging material 84 shown in FIG. 2B is provided integrally with the plate material.

As described above, there can be used various shapes of unit electrodes 81, however, it is not preferable to expose an end of the unit cathode by directly mounting the engaging member on the cathode plane of the unit cathode. If the engaging member is directly mounted on the cathode plane, the planarity of the cathode plane of the unit cathode cannot be sufficiently maintained.

Moreover, there is a possibility that the exposed end comes into contact with the ion exchange membrane, thereby damaging the ion exchange membrane. Thus, it is necessary to bend the end smoothly so that it may not be exposed on the cathode plane.

In the ion exchange membrane electrolyzer of the present invention, at least one electrode is held by means of plate spring bodies inserted into one another, and the electrode is mounted by means of an engaging member so as to enable the electrode to move only in a direction vertical to the electrode plane within the movable range of the plate spring bodies. Therefore, the present invention can provide an ion exchange membrane electrolyzer not only capable of maintaining the gap between the electrodes at a predetermined extent without causing the lateral displacement of the electrodes and the like, but also capable of returning to the former state after removal of the pressure even if the electrode is pushed from the counter electrode side at the time of pressure defect.

What is claimed is:

1. An ion exchange membrane electrolyzer, wherein at least one electrode is energized by coming into contact with plate spring bodies formed on the electrode side of an electrode holding member forming a space with an electrode chamber partition bonded to a plate-like electrode chamber partition by a strip-like bonded portion, the electrode has a connected portion extending from a plane parallel to the ion exchange membrane toward the electrode holding member side in a direction perpendicular to the electrode plane, the connected portion is provided with an engaging opening extending in a direction perpendicular to the electrode plane, and the engaging opening engages with an engaging member, permitting the electrode to move in a direction perpendicular to the electrode plane within the displacement range of the plate spring bodies.

2. The ion exchange membrane electrolyzer according to claim 1, wherein the engaging opening is an opening formed in the connected portion of the electrode extending from a plane parallel to the ion exchange membrane in a perpendicular direction or an opening formed in an engaging member mounted on the connected portion.

3. The ion exchange membrane electrolyzer according to claim 1, wherein the plate spring bodies comprise a plurality of comb-like spring-like bodies having the same length and extending obliquely from plate-like bodies of the electrode holding member.

4. The ion exchange membrane electrolyzer according to claim 1, wherein the plate-like bodies to which the plate spring bodies are connected are formed in a portion joined to the electrode chamber partition by the strip-like bonded portion, being parallel to the electrode chamber partition and forming a space with the electrode chamber partition, the space formed with the electrode chamber partition is a descending flow channel of an electrolyte and an ascending flow channel of an electrolyte is formed on the electrode side.

* * * * *